United States Patent [19]

Staub

[11] 4,112,605

[45] Sep. 12, 1978

[54] GUN RECOIL REDUCER

[76] Inventor: John W. Staub, 261 Herbert, Alton, Ill. 62002

[21] Appl. No.: 807,912

[22] Filed: Jun. 20, 1977

[51] Int. Cl.[2] ..... F41C 27/00

[52] U.S. Cl. ..... 42/1 V

[58] Field of Search ..... 42/1 V, 1 R, 74

[56] References Cited

U.S. PATENT DOCUMENTS

| | | | |
|---|---|---|---|
| 3,191,330 | 6/1965 | Olson | 42/1 V |
| 3,290,815 | 12/1966 | Edwards | 42/74 |
| 3,300,889 | 1/1967 | Baker | 42/1 V |
| 3,335,515 | 8/1967 | Bennett | 42/74 |
| 3,381,405 | 5/1968 | Edwards | 42/74 |
| 3,408,062 | 10/1968 | Baker | 42/74 |

*Primary Examiner*—Charles T. Jordan

*Attorney, Agent, or Firm*—F. Travers Burgess

[57] ABSTRACT

A recoil reducer for guns, particularly shoulder-fired guns, comprises a sealed elongated cylinder partially filled with a heavy liquid such as mercury and divided into at least two chambers by partition structure formed with a restricted orifice through it so as to retard forward movement of the mercury from the rear to the forward chamber when the gun recoils, the reducer preferably being mounted in the gun with its rear end lower than its forward end so that the rear chamber is normally full of liquid and the forward chamber is only partially filled, the heavy liquid due to its inertia reacting against the forward wall of the cylinder and the rear surface of the partition in opposition to the rearward movement of the gun during recoil, combining with the retarded flow of liquid through the orifice connecting the rear chamber to the forward chamber, to absorb much of the energy of recoil.

10 Claims, 5 Drawing Figures

GUN RECOIL REDUCER

BACKGROUND OF THE INVENTION

1. Field of the Invention

The invention relates to firearms and particularly to a recoil reducing device for use with shoulder-fired firearms.

2. The Prior Art

The provision of inertia-type recoil reducers has been previously suggested but such previous devices have generally embodied a cylinder slidably mounting a spring-loaded weight or piston, such as the devices disclosed in R. L. Shockey U.S. Pat. No. 2,627,686; S. C. Baker U.S. Pat. No. 3,300,889; J. B. Edwards U.S. Pat. No. 3,381,405; F. Wesemann U.S. Pat. No. 3,405,470; and I. D. Vironda U.S. Pat. No. 3,461,589. R. E. Bennett U.S. Pat. No. 3,335,515 discloses an anti-recoil device for guns comprising a single chamber cylinder inserted in the stock from its butt end and partly filled with mercury so as to utilize the impingement of the mercury against the forward wall of the cylinder during recoil, due to inertia of the mercury to dampen recoil.

SUMMARY OF THE INVENTION

The invention provides an improved means for reducing recoil of a gun by the reaction of a heavy liquid such as mercury in a sealed container against rearwardly-moving surfaces of the gun-mounted sealed container as the gun moves rearwardly in recoil.

The effectiveness of the device to reduce recoil is increased by dividing the container into three chambers by a pair of transverse bulkhead partitions, each formed with a small orifice, so that the mercury reacts against the rear surface of the bulkhead as well as against the front wall of the container during recoil, and the restricted orifices retard the passage of the mercury from the rear chamber to the forward chamber.

The effectiveness of the device to reduce recoil is also enhanced by mounting the device on the gun with its rear end lower than its forward end, such that normally the liquid is substantially out of engagement with the forward wall of the device, whereby during rearward movement of the gun in recoil substantially the entire cross section of the liquid is brought into reactive engagement with rearwardly facing transverse wall surfaces of the device rather than merely a part of the cross sectional area of the liquid, as would be the case if the device were mounted in the gun in a normally horizontal position.

The inclined mounting of the device in the gun facilitates return of the liquid to its normal ready position with the rear and middle chambers full and the forward chamber only partly filled.

Auxiliary orifice means through the partition permits the passage of entrapped air between the forward to rear ends of the device and this facilitates the passage of mercury from end to end of the device during and after recoil.

DETAILED DESCRIPTION OF THE INVENTION

Figure 1:
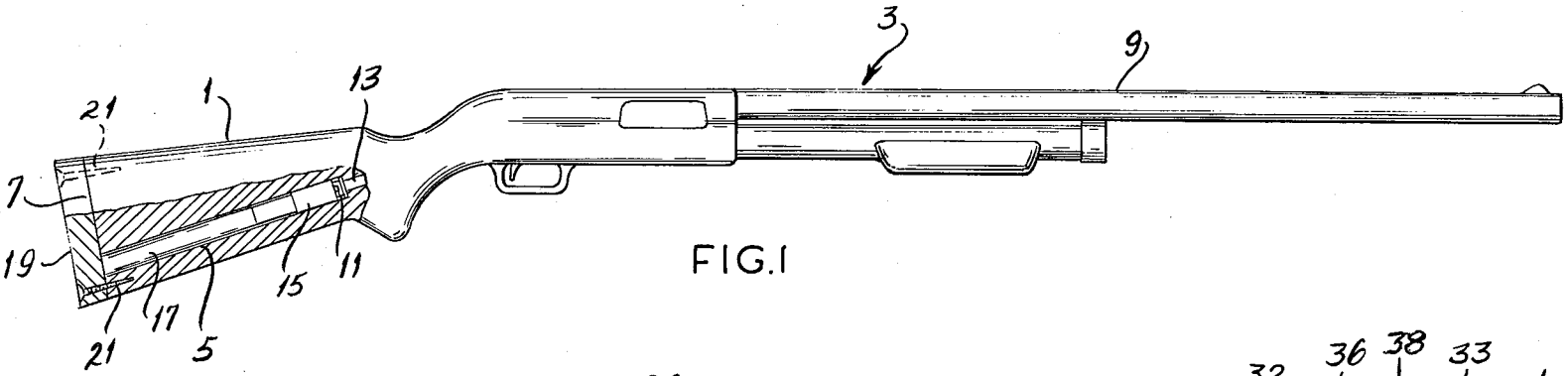
FIG. 1 is a side elevational view partially sectionalized of a shoulder-held firearm equipped with a recoil reducing device constructed in accordance with the invention.

The numeral 1 indicates the stock of a trap gun 3. The stock is formed with the usual draw bolt hole 5 extending forwardly from the butt and parallel to the lower edge of the stock, thus being inclined downwardly and rearwardly with respect to the axis of barrel 9. Substantially forwardly of the butt, head 11 of the draw bolt 13 is seated on a shoulder formed in the draw bolt hole.

The recoil reducing device of the present invention, generally indicated at 15 in FIG. 1, is inserted in the draw bolt hole with its forward end against draw bolt head 11 and is held against axial shifting in the draw bolt hole by a dowel 17 extending rearwardly from the rear end of the reducing device 15 to the rear end of the draw bolt hole 5 where it abuts butt plate 19 which is secured to the stock by screws 21.

The recoil reducer comprises a hollow cylinder 23, the rear end of which has a reduced outer diameter as at 25, the forward end of which is of suitable diameter for slidable reception in draw bolt hole 5.

Figure 5:
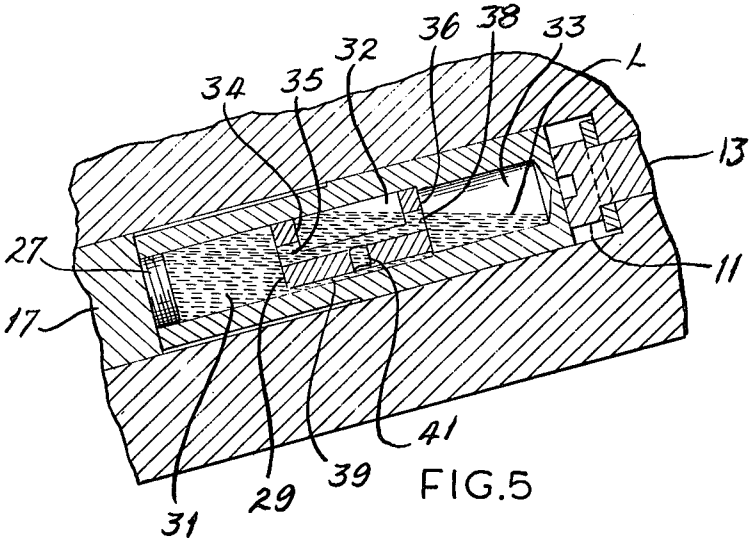
FIG. 5 is a longitudinal diametral sectional view of the device taken along lines 5—5 of FIGS. 2 and 3.
Figure 4:
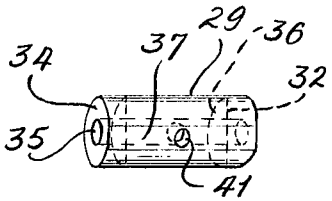
FIG. 4 is a three dimensional view of the plug used in the device to form a central partition dividing the device into two chambers.
Figure 2:
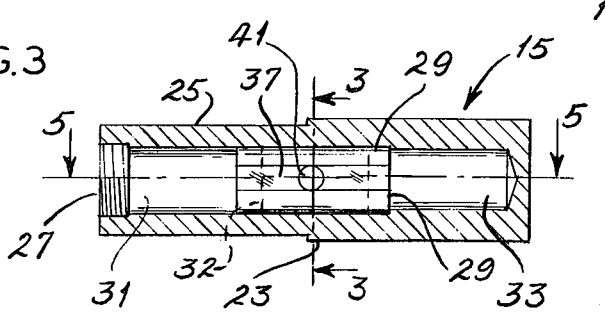
FIG. 2 is an enlarged longitudinal diametral sectional view of the recoil reducing device taken along line 2—2 of FIG. 3.
Figure 3:
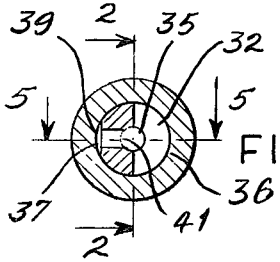
FIG. 3 is a transverse sectional view of the recoil reducing device taken along line 3—3 of FIG. 2.

Cylinder 23 is sealed at its rear end by a screw plug 27 and is provided intermediate its ends with a partition formed from a fixed cylindrical plug 29 dividing cylinder 23 into a rear chamber 31 and a forward chamber 33, and partially cut away intermediate its ends to form a middle chamber 32 and forward and rear bulkheads 34 and 36. Central orifices 35 and 38 of substantially less diameter than chambers 31 and 33 extend through bulkheads 34 and 36 to connect chambers 31,32 and 33, and the cylinder is partly (preferably about two-thirds) filled with mercury L, or with a liquid having similar characteristics and specific gravity, such that when the device 15 is secured in the draw bolt hole 5 as shown in FIGS. 1 and 5, as described above, the rear chamber 31 will be full of mercury and the middle and forward chambers will be only partly filled. Thus, when the gun is fired the inertia of the mercury will cause the mercury mass to remain substantially stationary, even though the entire gun moves rearwardly on recoil. As the gun, and with it cylinder 15, moves rearwardly, the substantially stationary mercury in rear chamber 31 reacts against bulkhead 34 and some of the mercury in rear chamber 31 is forced through orifice 35 into central chamber 32 where it reacts against bulkhead 36, thence through orifice 38 into forward chamber 33 where it reacts against the forward wall of the cylinder. The retardation effect of the reduced cross sectional area of orifices 35 and 38 on the flow of mercury during the rearward movement of the cylinder combines with the reaction of the mercury on the plug bulkheads and forward wall of the cylinder to absorb much of the recoil energy and reduce the recoil impact. During rearward movement of the gun and cylinder 23 during recoil, the air above the mercury in the forward and middle chambers is permitted to pass to the rear chamber through a shallow passageway 39 formed between a flat 37 on plug 29 and the inner surface of the cylinder, so that the full mass of the mercury can react against the forward surfaces of chambers 33 and 32, passageway 39 being connected to chamber 32 by lateral passage 41.

After each firing of the gun, the mercury returns to its normal condition by gravity principally by means of orifices 35 and 38 wherein it fills rear chamber 31 and only partly fills middle chamber 32 and forward chamber 33, as best seen in FIG. 5. Such return flow of the mercury is expedited by the return of the entrapped air, which had passed from the forward to the rear chamber during recoil via shallow passageway 39 and via lateral passageway 41 to the forward and middle chambers respectively.

The invention may be modified in various respects as will occur to those skilled in the art and the exclusive use of all such modifications as come within the scope of the appended claims is contemplated.

I claim:

1. A device for reducing recoil in a shoulder-fired firearm comprising a cylinder arranged to be mounted in a direction in part axially of the firearm, partition structure within said cylinder intermediate the ends thereof and dividing said cylinder into a forward and a rear chamber, said partition structure being provided with restricted orifice means through it of substantially less area than the internal cross section of said cylinder, and liquid of high specific gravity partially filling said cylinder, whereby to react against said partition structure and the forward end of said cylinder during rearward movement of the firearm during recoil thereof, said reaction and the retardation caused by the restricted orifice means through said partition structure combining to retard rearward movement of the firearm due to recoil and thereby absorb a substantial portion of the recoil energy.

2. A device according to claim 1 adapted for mounting on a firearm having an elongated barrel, in a direction downwardly and rearwardly inclined with respect to the axis of the barrel, whereby said rear chamber is normally full of liquid and said forward chamber is only partly filled.

3. A device according to claim 2 wherein said partition structure includes a pair of bulkheads spaced apart lengthwise of said cylinder to define between them a third middle chamber, said orifice means comprising separate orifices in the respective bulkheads.

4. A device according to claim 3 wherein said partition structure comprises a cylindrical plug force-fitted into a position substantially centered longitudinally of the hollow interior of said cylinder.

5. A device according to claim 3, including a separate passageway through said partition structure connecting said rear and forward chambers to facilitate passage of air from said forward chamber to said rear chamber during the recoil movement and return of air from said rear chamber to said forward chamber upon completion of the recoil movement.

6. A device according to claim 5, including a lateral passage in said partition structure between said middle chamber and said separate passageway.

7. In a shoulder-fired firearm having a barrel and a stock, a recess extending lengthwise of said stock from the rear end thereof with its axis inclined downwardly and rearwardly with respect to the axis of said barrel, a device for reducing recoil of the firearm comprising a cylinder mounted in said recess, partition structure within said cylinder intermediate the ends thereof and dividing said cylinder into an upper forward chamber and a lower rear chamber, said partition structure being formed with restricted orifice means through it of substantially less area than the internal cross section of said cylinder, and a liquid of high specific gravity completely filling said rear chamber and partially filling said forward chamber whereby to react against said partition structure and the forward end of said cylinder during rearward movement of the firearm during recoil thereof, said reaction and the retardation of flow of said liquid from said rear chamber to said forward chamber caused by the restricted orifice means through said partition structure combining to retard rearward movement of the firearm due to recoil and thereby absorb a substantial portion of the recoil energy.

8. In a shoulder-fired firearm according to claim 7, said partition structure including a pair of bulkheads spaced apart to define between them a third middle chamber, said orifice means comprising separate orifices in the respective bulkheads.

9. In a shoulder-fired firearm according to claim 7, said partition structure including a separate passageway connecting said rear and forward chambers to facilitate passage of air from said forward chamber to said rear chamber during recoil movement and return of air from said rear chamber to said forward chamber upon completion of the recoil movement.

10. In a shoulder-fired firearm according to claim 9, said partition structure defining a middle chamber between said forward and rear chambers, said orifice means comprising separate orifices connecting said middle chamber and said forward and rear chambers, said partition structure including a lateral passage between said middle chamber and said separate passageway.

* * * * *